United States Patent [19]

Mecke et al.

[11] Patent Number: 5,017,428

[45] Date of Patent: May 21, 1991

[54] MULTIPLE IMPRESSION THERMAL TRANSFER RIBBON

[75] Inventors: Norbert Mecke, Hanover; Heinrich Krauter, Neustadt, both of Fed. Rep. of Germany

[73] Assignee: Pelikan Aktiengesellschaft, Hanover, Fed. Rep. of Germany

[21] Appl. No.: 366,289

[22] Filed: Jun. 13, 1989

Related U.S. Application Data

[63] Continuation of Ser. No. 152,641, Feb. 5, 1988, abandoned.

[30] Foreign Application Priority Data

Feb. 7, 1987 [DE] Fed. Rep. of Germany ..... 3703813

[51] Int. Cl.[5] ..... B41M 5/26

[52] U.S. Cl. ..... 428/336; 428/195; 428/484; 428/488.1; 428/522; 428/913; 428/914

[58] Field of Search ..... 428/195, 207, 336, 480, 428/483, 484, 488.1, 500, 522, 913, 914; 427/146

[56] References Cited

U.S. PATENT DOCUMENTS

| | | | |
|---|---|---|---|
| 3,944,695 | 3/1976 | Kosaka et al. | 428/914 |
| 4,347,282 | 8/1982 | Ehrhardt et al. | 428/914 |

FOREIGN PATENT DOCUMENTS

| | | | |
|---|---|---|---|
| 0194860 | 9/1986 | European Pat. Off. | 428/195 X |
| 0214770 | 3/1987 | European Pat. Off. | 428/195 X |

OTHER PUBLICATIONS

BASF Product Bulletin, 2 pages, "Eva 1-Wachs BASF".

*Primary Examiner*—Pamela R. Schwartz
*Attorney, Agent, or Firm*—Herbert Dubno

[57] ABSTRACT

A thermal transfer ribbon, suitable for printing of multiple sharp impressions, employs as the binder for its fusible colorant layer an olefin/vinyl ester copolymer, particularly an ethylene/vinyl acetate copolymer having the ratio of vinyl acetate units to ethylene units of about 0.01 to 0.07. The ribbon is conveniently made by coating a solution of this polymer, with the colorant substance dissolved or dispersed therein, onto a substrate such as a synthetic polyester film.

5 Claims, No Drawings

MULTIPLE IMPRESSION THERMAL TRANSFER RIBBON

This is a continuation of co-pending application Ser. No. 07/152,641 filed on Feb. 5, 1988 now abandoned.

FIELD OF THE INVENTION

Our present invention relates to thermal transfer ribbons usable with thermal printheads. In particular the invention relates to thermal transfer ribbons which are capable of producing several print impressions from the same area of ribbon, i.e. to multistrike ribbons.

Our invention also relates to a process for manufacture of the improved thermal transfer ribbons

BACKGROUND OF THE INVENTION

Thermal transfer, ribbons, also variously called film ribbons, thermocolor ribbons, thermal color ribbons, thermocarbon ribbons, thermal carbon ribbons, or thermally activated image transfer ribbons, have been known for a long time.

They typically have a film-like substrate, also known as a base or carrier, which may consist of paper, plastic foil (film), or some other suitable flat thin substrate, bearing a fusible pigmented layer, this layer typically consisting of colorant substance such as a dyestuff or carbon black bonded by a fusible plastic or a wax. By virtue of this fusible material, the colorant substance may be transferred by way of the melt onto the item to be printed, such as paper, through the action of a printhead which applies heat and pressure to the ribbon.

Thermal printers and thermal/pressure printheads suitable for this process are disclosed for example in German patent documents DE-AS 2 062 494 and DE-AS 2 406 613 as well as in German Application DE-OS 3 224 445.

In greater detail, the process can be described as follows: on a thermal/pressure printhead of the printer, the letter to be printed is formed by heated points. The printhead presses the thermal transfer ribbon against the paper to be printed. The heated letter, having a temperature of about 400° C., causes the fusible colorant layer to melt off and transfer to the paper to be printed. The used part of the thermal ribbon is then carried to a spool.

The thermal transfer ribbon can have various fusible colorants in combination. With the combination of three basic colors, blue, yellow, and red, multicolored printing can be accomplished. In contrast to ordinary color photography, the troublesome steps of developing and fixing can be dispensed with. Thermal printers can be operated at high speed—a DIN (German Industrial Standard)—A4 page can be printed in about 10 seconds—and without producing a troublesome level of noise.

Besides the above described thermal transfer ribbons, there is also a type whereby the thermally printed character is not produced by a thermal/pressure printhead but by resistance heating of an especially-constituted filmlike substrate. The fusible colorant, which is the functional layer here as in the pressure process, also contains the constituents described above. In commerce these devices are called "electrothermal ribbons". This type of thermal printing system is described, for example, in U.S. Pat. No. 4,309,117.

Thermal transfer ribbons are already known which can produce multiple impressions, often called multi-use ribbons. Such ribbons are described for example in European Patent No. A-0 063 000. The fusible colorant of these thermal transfer ribbons is a particulate material, insoluble in the fluid medium used to coat the ribbons, and which does not melt below 100° C., interspersed with an additional particulate material with a melting point between 40° and 100° C. The particulate material which does not melt below 100° C. advantageously consists of a metal oxide, a metal, an organic resin, or carbon black. By means of this special particulate material, the layer of fusible colorant, which itself is a solid mixture, is given a heterogeneous structure, from which only a portion of the transferable molten colorant is expended on each application of pressure.

However, with thermal transfer ribbons of this sort, improvements are needed in print quality, especially with regard to the sharpness of definition of the printing. In this regard, the greatest improvement results from having a sponge-like structure of the fusible colorant as in German Application 35 20 308. This is produced by a special process wherein a coating fluid is applied to the substrate film of the ribbon in the usual way; this coating fluid has dissolved in it a thermoplastic binder and also has dispersed in it a finely divided solid wax or waxlike substance. This coating fluid employs as its solvent medium a mixture of a room-temperature solvent and a non-solvent for the thermoplastic binder. The non-solvent/solvent mixture evaporates off with simultaneous loss of its solvency for the thermoplastic binder. This product, like those described earlier, still does not perform in a totally satisfactory manner for making multiple impressions.

OBJECTS OF THE INVENTION

It is a principal object of the invention to provide a thermal transfer ribbon which affords improved print quality (print sharpness) even when the ribbon is used to make multiple impressions, i.e. is a multistrike ribbon.

A further object of the invention is to provide a thermal transfer ribbon, especially a thermal transfer ribbon for making multiple impressions, which affords maximal use of the fusible colorant.

It is also an object of the invention to provide a convenient method for manufacture of an improved thermal transfer ribbon.

SUMMARY OF THE INVENTION

The objects of the invention are achieved with a thermal transfer ribbon having on the substrate a fusible colorant layer which has, as its principal fusible and transferable ingredient, a copolymer of an alkene and a vinyl compound, this copolymer having the formula:

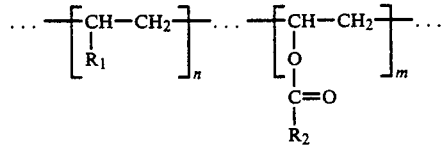

wherein $R_1$ is hydrogen or a lower alkyl group having 1 to 4 carbon atoms, $R_2$ is a lower alkyl group having 1 to 3 carbon atoms, n and m are the numbers of the monomer units in the copolymer, and the ratio of m to n is between about 0.01 and 0.07.

The essential feature of the invention therefore consists of the choice of the specific copolymer described above as the fusible binder substance in the fusible colorant layer. Although this binder shows certain similarities to the waxes which have customarily been used as binders for the fusible colorant, a sharp distinction is evident; none of the wax bonded colorants of the prior art could give adequate print sharpness in multiple impressions since as a rule complete color transfer would occur as soon as heat and pressure were applied. The binder selected in accordance with the present invention behaves quite differently.

It has been found that amongst the compositions within the scope of the aforegiven formula, the most advantageous ones are those where $R_1$ is a hydrogen atom and where $R_2$ is a methyl group. It will be understood that under the term "lower alkyl group," the methyl, ethyl, propyl, isopropyl, and butyl groups are encompassed.

A substance for use in the fusible colorant, within the range of the preferred formula, is the ethylene-vinyl acetate copolymer wherein, in accordance with the invention, the ratio m/n is between 0.01 and 0.07 and preferably between 0.025 and 0.035. This is the substance described in all further examples herebelow.

This means that the binder chosen in accordance with the invention is advantageously an ethylene wax, modified to a small degree by the copolymerization of vinyl acetate.

In the development of the present invention, it was further found that the commercially available binder known as EVA 1-Wax (made by BASF) permits an especially large number of multiple impressions, for instance up to 20 impressions. At the same time, the print impressions thus made have very satisfactory sharpness. This product is characterized by the following approximate physical parameters: melting point (Monoskrupt method): 87° to 92° C.; solidification point (by the standard method of the Deutschen Gesellschaft für Fettwissenschaft e. V., Münster/Westfalen M-III 4 a): 83°-87° C.; Hoppler hardness at 23° C. (DGF-M-III 9 a): 100-140 bar; melt viscosity at 120° C. (DGF=M-III 8): 1680 to 1880 $nm^2/s$; average molecular weight (viscometric): 6500-7000; vinyl acetate content: 8.5-9.5 %.

The binder, as above described, is the main constituent of the fusible colorant of the thermal transfer ribbon in accordance with the invention. To this main constituent is added a colorant substance, preferably to the extent of about 10 to 40 wt. %. The type of colorant substance is not critical for the accomplishment of the objects of the invention. Thus, it can be an inorganic or an organic colorant, and in either case, of natural or synthetic origin. The inorganic colorants include pigments, such as carbon black, and in some cases have the character of fillers. The colorants also encompass dyes soluble in the solvent and/or in the binder. Examples include triphenylmethane dyes such as Victoria Blue B (C. I. Basic Blue), Ink Blue (C. I. Acid Blue 93) and Water Blue T. B. A. (C. I. Acid Blue 22), azo dyes such as Sudan Deep Black BB (C. I. Solvent Black 2) and Sudan Brown 1 (C. I. Solvent Brown 1), metal complex dyes such as Neozapon Black RE (C. I. Solvent Black 27) and Neozapon Blue FLE (C. I. Solvent Blue 70) and spirit-soluble dyes such as Spirit Blue (C. I. Solvent Blue and Spirit Soluble Fast Black (C. I. Solvent Blue 70).

The minimum components of the fusible colorant of the thermal transfer ribbon of the invention are therefore the above-described specific binder and the colorant substance.

The thickness of the layer of fusible colorant layer is not critical for the attainment of the objects of the invention. It should, however, be thicker the greater the intended number of multiple impressions. In practical applications, the thickness of the fusible colorant layer is about 5 to 20, preferably about 8 to 12 micrometers.

Likewise, the type of substrate is not critical for the attainment of the objects of the invention. On the contrary, depending on particular requirements of the situation, one skilled in the art will readily be able to select amongst the films (foils) available in the art based on their published properties. It has, however, been found that synthetic films are preferable in regard to their thermal and mechanical stability. At the present state of the art, the following materials are found to be suitable; polyesters, especially polyethylene terephthalate, polycarbonates, polyamides, vinyl polymers, especially polyvinyl chloride, polyvinyl acetate, polyvinyl alcohol, and polyvinyl propionate, polyolefins especially polyethylene, polypropylene, and polystyrene. These films can also contain a plasticizer to improve their flexibility.

Moreover, additives can be used to improve the heat conductivity. In the case of the application of the thermal transfer ribbon of the invention to the resistance heating process (electrothermal system), the plastic substrate should contain an electroconductive material in finely divided dispersion, for example, an electroconductive carbon black. In this case, the substrate film is advantageously about 10 to 15 micrometers thick, whereas the thickness in the case of a thermal/pressure printhead should be about 3 to 6 micrometers. It will be understood that these ranges may be extended more or less in either direction.

In the manufacture of the thermal transfer ribbon of the invention, it is advantageous to proceed as follows: The binder for the fusible colorant, defined above as conforming to the invention, is dissolved in an aromatic solvent such as toluene, xylene or the like, to about 15-25 wt. % concentration. To this solution is preferably added the color producing component in such an amount that it constitutes about 10 to 40 wt. % on a dry solids basis. The thus-obtained solution or dispersion is coated in the usual way at about 50 micrometers thickness. Thus, the amount applied is about 50 g per square meter of substrate surface. For the application, for example, a doctor blade can be used. The application can be done at room temperature. Then, the coated substrate is passed through a drying tunnel, in which the solvent is evaporated off. In applications from a solution or dispersion, it has been found that the quality of the fusible colorant layer thus formed is better if the applied fluid has a dispersant adjuvant in the form preferably of a fatty acid and/or suitable derivatives thereof.

Suitable fatty acids include especially myristic, palmitic, stearic, and oleic acids. Suitable derivatives include for instance esters and amides of fatty acids, especially fatty esters of multivalent alcohols such as glycol and glycerol. The quantity of the dispersion adjuvant in the applied solution or dispersion is preferably in the range of 1 to 5 wt. % on a dry weight basis.

The advantages which are achieved by the invention may be summarized as follows: The thermal transfer ribbons of the invention may be made without difficulty; their coloring capacity is fully utilized; residual color does not remain after the last multiple impression; no print blurring adjuvant substances are present. These advantages were unattainable in any of the known prior art thermal transfer ribbons.

To further explain the invention, the following working example is given:

EXAMPLE

A modified polyethylene wax, based on an ethylene/-vinyl acetate copolymer with a vinyl acetate content of about 10 wt. %, was mixed with carbon black and toluene. Thus, 70 parts by wt. of polyethylene wax, 30 parts by wt. of carbon black, and 400 parts by wt. of toluene were used. After brief stirring, the modified polyethylene wax went into solution. The suspension was applied at a rate of 50 g per square meter to a polyester film by means of a doctor blade to achieve a thickness of about 6 micrometers.

Then, the coated substrate was conducted through a drying tunnel of the usual type, and the toluene solvent was evaporated off at about 80° C. The thus-obtained thermal transfer ribbon without further manufacturing steps was found to give twenty consecutive sharply-printed impressions.

The above description is not to be construed as limiting and is presented for purposes of illustration of a preferred embodiment.

We claim:

1. A thermal transfer ribbon, suitable for making multiple impressions, comprising:

a substrate; and a fusible colorant layer on one side of said substrate, said layer consisting essentially of about 10–40% colorant substance, optionally a dispersant in an effective amount for dispersing said colorant substance and a fusible binder which is a wax that is a copolymer of the formula:

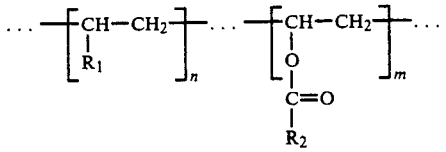

wherein $R_1$ is hydrogen, $R_2$ is methyl, n and m are the numbers of the monomer units in the copolymer, and the ratio of m to n is between about 0.01 and 0.07, said binder being the principal fusible and transferable ingredient in said colorant layer, and wherein said copolymer is a modified ethylene wax having a melting point of about 87° to 92° C., solidification point of about 83° to 87° C., Hoppler hardness at 23° C. of about 100 to 140 bar, melt viscosity at 120° C. of about 1650 to 1850 $nm^2/s$, average molecular weight (visometric) of about 6500 to 7000, and vinyl acetate content of about 8.5 to 9.5%.

2. A thermal transfer ribbon as defined in claim 1 where said colorant substance is carbon black.

3. A thermal transfer ribbon as defined in claim 1 where said dispersant is selected from the group consisting of a fatty acid, a fatty acid ester, and a fatty acid amide.

4. A thermal transfer ribbon as defined in claim 1 where said dispersant is present in said colorant layer at about 1 to 5 weight percent.

5. A thermal transfer ribbon as defined in claim 1 suitable for use in a resistance heating process for thermal transfer printing wherein said colorant substance is electroconductive carbon black and said colorant layer is about 10 to 15 micrometers in thickness.

* * * * *